US005728227A

United States Patent [19]

Reverman

[11] Patent Number: 5,728,227

[45] Date of Patent: Mar. 17, 1998

[54] METHOD FOR REMOVING A DIFFUSION COATING FROM A NICKEL BASE ALLOY

[75] Inventor: Jeffrey J. Reverman, Cincinnati, Ohio

[73] Assignee: General Electric Company, Cincinnati, Ohio

[21] Appl. No.: 664,762

[22] Filed: Jun. 17, 1996

[51] Int. Cl.[6] ..... C03C 23/00; B08B 5/00; B08B 7/00; B08B 7/04

[52] U.S. Cl. ..... 134/2; 134/11; 134/19; 134/31; 134/37

[58] Field of Search ..... 134/2, 11, 15, 134/31, 37

[56] References Cited

U.S. PATENT DOCUMENTS

| | | | |
|---|---|---|---|
| 2,380,202 | 7/1945 | Stroup | 148/21.3 |
| 2,679,466 | 5/1954 | Spendelow, Jr. et al. | 148/13.1 |
| 3,287,181 | 11/1966 | Steverding | 148/20.3 |
| 3,490,958 | 1/1970 | Robinson, Jr. | 148/13.1 |
| 4,098,450 | 7/1978 | Keller et al. | 228/119 |
| 4,188,237 | 2/1980 | Chasteen | 134/2 |
| 4,249,963 | 2/1981 | Young | 148/16 |
| 4,405,379 | 9/1983 | Chasteen | 134/2 |
| 4,842,183 | 6/1989 | Antony et al. | 228/119 |
| 5,016,810 | 5/1991 | Sikka | 228/206 |
| 5,346,563 | 9/1994 | Allen et al. | 148/675 |
| 5,373,986 | 12/1994 | Rafferty et al. | 228/206 |

*Primary Examiner*—Ardin H. Marschel
*Assistant Examiner*—Jezia Riley
*Attorney, Agent, or Firm*—Andrew C. Hess; David L. Narciso

[57] ABSTRACT

A method for removing a diffusion coating which includes Al from a Ni base alloy surface portion comprises mechanically removing substantially a coating outer portion disposed on a coating diffused inner portion, and then depleting Al from the exposed diffused inner portion. Such depletion is by exposing the inner portion to a reducing gas comprising greater than about 6 wt. % halogen gas, for example a mixture of up to about 20 wt. % of a hydrohalogen gas, such as hydrogen fluoride gas, with the balance principally hydrogen gas. The temperature of exposure is at least about 1600° F., preferably about 1600°–2000° F. for about 2–10 hours.

4 Claims, No Drawings

METHOD FOR REMOVING A DIFFUSION COATING FROM A NICKEL BASE ALLOY

FIELD OF THE INVENTION

This invention relates to removal of a diffusion coating from a surface portion of alloys, and, more particularly, to removal from Ni-base superalloys of a diffusion coating which includes aluminum.

BACKGROUND OF THE INVENTION

Certain gas turbine engine components operating at relatively high temperatures in the engine experience strenuous environmental operating conditions. To enhance operating life, such components generally are provided with a surface protective coating. One frequently used type of such coating includes the element aluminum, alone or in combination with other elements. The commercial diffusion aluminide type of coating is one example in which Al or an alloy including Al is applied to a surface to be protected and then is heated to diffuse at least a portion of the coating into an article substrate. U.S. Pat. No. 3,667,985—Levine et al., patented Jun. 6, 1972, describes a form of aluminide coating commercially available as Codep aluminide coating. Another widely reported type of protective coating used commercially with gas turbine engine articles is the M-Cr-Al-Y type of coating in which the "M" is Fe, Co, Ni, or their combinations. At least a portion of the Al in the coating is diffused into an article substrate.

High temperature operating gas turbine engine components, such as high pressure turbine blades, vanes, nozzles, and shrouds, in addition to including a surface protective coating, frequently include internal air cooling passages or cavities which exit through openings in an external surface of the article, for example to provide film cooling on the external surface. Air flow through and about such components, as well as the overall component shape, are designed to be within relatively narrow dimensional limits to develop and maintain engine operating efficiency. It can be appreciated that such articles are relatively expensive to manufacture, being complex in shape and generally of a relatively complex Ni-base superalloy, sometimes in the form of substantially a single crystal or directionally solidified multi-elongated grain microstructure. Accordingly, when some damage occurs to such an article, such as during initial manufacture or subsequent engine operation, is it economically more attractive to repair rather than to replace the article.

Repair of such an article generally includes initial removal of the surface protective coating at least at an area to be repaired, for example to enable weld or braze repair of cracks, crevices, abraded portions, missing surface portions, etc., or to clean a surface portion of products of combustion such as oxides, sulfides, etc. Certain coating stripping liquids commercially used for aluminide coating removal are acidic in nature, for example including the hydrochloric acid, or a mixture of nitric and phosphoric acids, or other highly erosive acid or combination of acids, which can etch and remove a portion of the article surface to which it is applied. Use of such coating stripping materials within surface connected air cooling openings can result in enlargement of the openings to the extent that airflow characteristics are changed detrimentally and the article must be replaced.

SUMMARY OF THE INVENTION

The present invention, in one form, provides a method for removing a diffusion coating which includes Al from a Ni base alloy surface portion, for example within a surface connected opening, substantially without change in original surface or opening dimension. The coating includes a coating inner portion diffused into the alloy surface portion or substrate, and a coating outer portion bonded with the coating inner portion, such as to constitute an additive layer on the substrate. The method of the present invention first mechanically removes substantially the outer coating portion, such as by grit blasting, grinding or otherwise abrading the outer portion, to expose the diffused coating inner portion. Then the exposed inner portion is subjected to a reducing gas comprising greater than 6 weight % of a halogen gas, such as a fluoride gas, for example in the range of greater than 6 wt. % up to 20 wt. % of a hydrohalogen gas with the balance principally hydrogen gas, at a temperature of at least 1600° F., and preferably in the range of 1600°–2000° F., for a time, preferably in the range of 2–10 hours, sufficient for the reducing gas to deplete Al from the diffused coating inner portion. Such depletion of the Al can be considered to reverse the prior diffusion of Al into the surface portion, in a manner which results in substantially no detrimental dimensional change in the surface portion, for example as occurs with an acid or alkali chemical stripping of such diffused portion.

DESCRIPTION OF THE PREFERRED EMBODIMENTS

As the gas turbine engine art has advanced to develop more complex designs, particularly air cooled components, development of efficient repair methods has become increasingly more important. As was mentioned, environmental protective coatings, including those diffused into an alloy article substrate, generally must be removed at least from an article surface to be repaired, prior to other repair processes. A large group of such coatings include the element Al at least a portion of which is diffused into the surface portion of the article, with an outer, additive layer bonded or integral with the diffused portion. The additive zone is characterized by an Al rich layer added to the original surface of the component. The diffused portion has an Al concentration gradient, which is a function of the diffusion application process, with the amount of Al declining with increasing depth from the original surface. Therefore the diffused portion substantially does not change the original component dimension, whereas application of the outer coating portion adds to such dimension and must be considered in the design of the component.

During repair of some relatively simple components, removal of both the outer additive and inner diffused portion by typical chemical or mechanical means, resulting in reduction of a surface dimension, can be compensated for by adding more coating during the repair method. However, such typical coating removal prior to repair of air cooled components in the area of air cooling exit openings, which can result in the increase in the size of such openings, presents a more complex and more costly repair procedure. For example, resizing of the cooling openings can involve recoating the openings and then reshaping the openings, such as through material removal methods, for example using electrodischarge machining or laser. The present invention, through the combination of two distinct and different steps for diffused Al coating removal, obviates such additional, subsequent repair procedures. In the present method, the outer, additive coating portion first is removed mechanically to expose the inner diffused portion. Then the prior Al diffusion is reversed by removing Al through its exposure to a reducing halogen gas, such as a hydrofluoride gas, for example a mixture of hydrogen fluoride gas and hydrogen gas, which draws or depletes Al from the substrate with substantially no change in the dimension of the substrate. Exposure to such gas is at a temperature of at least 1600° F., and preferably in the range of 1600°–2000° F., for a time, generally at least about 2 hours and preferably 2–10 hours, sufficient for the reducing halogen gas to deplete Al from the diffused coating inner portion, to enable subsequent repair procedures to be practiced.

Fluoride ions have been reported for use in removing surface contaminants in preparation for subsequent repair. Keller et al. in U.S. Pat. No. 4,098,450 (patented Jul. 4, 1978) remove oxides of Al or Ti or both by exposing a damaged surface to fluoride ions. Then a repair brazing alloy is used at the cleaned portion. Such use of fluoride ions was modified by Chasteen in U.S. Pat. Nos. 4,188,237 and 4,405,379 (patented Feb. 12, 1980 and Sep. 20, 1983, respectively). Gases including fluorides have been used to decarburize surfaces as well as to act as a "getter" atmosphere for oxygen to attempt to avoid oxidation in some types of heat treatments. However, the present invention recognizes that exposure of diffused Al to a reducing fluoride gas, typically hydrogen fluoride gas, can draw the Al from the diffused portion without dimensional change by reacting the Al with the gas at a temperature of at least about 1600° F. and for a time sufficient to deplete Al from the portion. Such exposure is enabled by the mechanical removal of the outer or additive layer of the coating.

During evaluation of the present invention, it was recognized that a reducing fluoride gas, alone or in a reducing gas mixture, was preferred to react with Al diffused in a Ni base alloy substrate. Furthermore, it was found that at least 6 wt. % of a fluoride gas such as hydrogen fluoride was needed at a temperature of at least 1600° F. to enable such depletion of Al to occur. In some Ni base superalloys, it was recognized that greater than 20 wt % hydrogen fluoride gas in a mixture with hydrogen gas could result in intergranular attack or undesired alloy depletion in the exposure time range of greater than about 10 hours in the temperature range of 1600°–2000° F. Therefore, a preferred form of the method of the present invention, when used with Ni base superalloys, is conducted in the range of 1600°–2000° F. for 2–10 hours.

In one example, a Codep aluminide coated air cooled high pressure turbine nozzle was damaged in an area which included air cooling exit openings. To make a repair, such as by welding, it was found necessary to remove the aluminide coating prior to such repair. The nozzle was made of a Ni base superalloy commercially identified as Rene' N4, consisting nominally by weight of about: 7.5% Co, 4.2% Al, 9.8% Cr, 3.5% Ti, 4.8% Ta, 6% W, 1.5% Mo, 0.5% Nb, 0.15% Hf, 0.06% C, 0.004% B, with the balance Ni and incidental impurities.

Use of a standard commercial acid stripping solution including, by weight about 50% nitric acid and about 50% phosphoric acid, designed to remove aluminide coatings, had in previous evaluations resulted in enlargement of the cooling openings to the extent that the article could no longer be repaired and was scrapped. According to the present invention, the above described Codep aluminide coating was removed from the surface portion of such an article in two distinct, discrete steps. The outer, additive portion of the coating was removed mechanically by ordinary commercial grit blasting to expose the diffused coating inner portion. This mechanical outer coating removal had substantially no effect on the size or dimensions of the cooling openings. Thereafter, the exposed diffused inner portion was subjected to a reducing halogen gas, in this example a mixture in the range of greater than about 6 wt. % up to 20 wt. % hydrogen fluoride with the balance principally hydrogen gas, and more specifically nominally 13 wt % hydrogen fluoride. Exposure was at a temperature of about 1900° F. for about 4 hours, which in this example was sufficient to deplete adequate Al from the surface to be repaired to enable successful weld repair. Subsequent inspection of the cooling openings showed that practice of the method of the present invention maintained air cooling opening dimensions substantially at their original amounts.

In other evaluations of the present invention, the practical, preferred range for the reducing gas mixture described above, for use with Ni base superalloys, is about 10–15 wt. % hydrogen fluoride, with the balance principally hydrogen gas. Greater than 6 wt. % hydrohalogen gas is required in the reducing gas mixture because less than that amount was insufficient to deplete the amount of Al required for subsequent repair. Also, it was recognized that greater than 20 wt % of such gas could result in intergranular attack or undesired alloy depletion or both.

The present invention has been described in connection with various specific examples, embodiments and combinations. However, it will be understood by those skilled in the arts involved that this invention is capable of a variety of modifications, variations and amplifications without departing from its scope as defined in the appended claims.

I claim:

1. In a method for removing from a surface portion of an article, made from a Ni base alloy, a diffusion coating which includes the element Al, the coating including a diffused coating inner portion in which at least Al is diffused into the alloy surface and a coating outer portion bonded with the inner portion, the steps of:

mechanically removing substantially the coating outer portion to expose the diffused coating inner portion; and then, subjecting the exposed inner portion to a reducing gas comprising greater than 6 wt. % halogen gas at a temperature of at least 1600° F. for a time of at least 2 hours sufficient for the halogen gas to deplete Al from the coating inner portion substantially without dimensional change of the inner portion.

2. The method of claim 1 in which:

the reducing gas is a mixture of greater than 6 wt. % up to 20 wt. % of a hydrohalogen gas, with the balance principally hydrogen gas;

the temperature is in the range of 1600°–2000° F.; and, =p1 the time of exposure is in the range of 2–10 hours.

3. The method of claim 2 in which:

the alloy is a Ni base superalloy;

the surface portion includes air cooling openings therethrough;

the reducing mixture of gases comprises about 10–15 wt. % hydrogen fluoride gas, with the balance principally hydrogen gas; and, the depletion of Al from the coating inner portion at the air cooling openings substantially does not change dimensions of the air cooling openings.

4. The method of claim 3 in which the time of exposure is in the range of about 2–6 hours.

* * * * *